US005381325A

United States Patent [19]

Messana

[11] Patent Number: 5,381,325

[45] Date of Patent: Jan. 10, 1995

[54] SELF-POSITIONING LAMP FIXTURE WITH STABILIZING BASE

[76] Inventor: Joseph Messana, 1343 S. Schmuhl Rd., New Lenox, Ill. 60451

[21] Appl. No.: 19,491

[22] Filed: Feb. 19, 1993

[51] Int. Cl.[6] ..... F21V 21/06

[52] U.S. Cl. ..... 362/410; 362/387; 362/390; 362/401; 362/399

[58] Field of Search ..... 362/410, 387, 390, 401, 362/399, 294, 373

[56] References Cited

U.S. PATENT DOCUMENTS

| | | | |
|---|---|---|---|
| 1,228,615 | 6/1917 | Stafford | 362/401 |
| 3,247,370 | 4/1966 | Lynn | 362/410 |
| 4,870,552 | 9/1989 | Vitta et al. | 362/390 |
| 5,001,617 | 3/1991 | Chan | 362/401 |
| 5,134,555 | 7/1992 | Messana | 362/410 |

*Primary Examiner*—Richard R. Cole
*Attorney, Agent, or Firm*—Ernest Kettelson

[57] ABSTRACT

A self-positioning light fixture with a stabilizing base comprises a self-righting member in the shape of a spherical segment and a separate lamp supporting member with connecting means to join the two together and to separate each from the other. When separated, a filling neck or spout on the top wall of the self-righting member is exposed through which fluid ballast material such as sand may be poured into the cavity of the self-righting member. The filling neck has external threads to engage the internal threads of a recess opening to the bottom wall of the lamp supporting member when received therein to thereby couple the two members together. Additional fastening screws are provided to more securely connect the self-righting member to the lamp supporting member. A shock absorbing mechanism is provided comprising mounting springs to secure the lamp bulb socket member to the lamp supporting member and thereby protect it from shocks transmitted to the lamp fixture. The spherical segment self-righting member when filled with ballast material and connected to the lamp supporting member will rotate the fixture back to its upright position if tilted away therefrom. A flat bottom wall of the spherical segment self-righting member stabilizes the fixture on its upright position.

32 Claims, 13 Drawing Sheets

FIG. 4
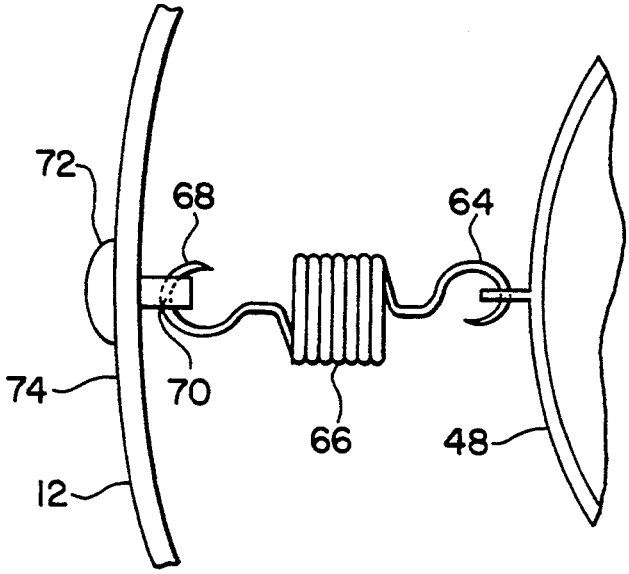
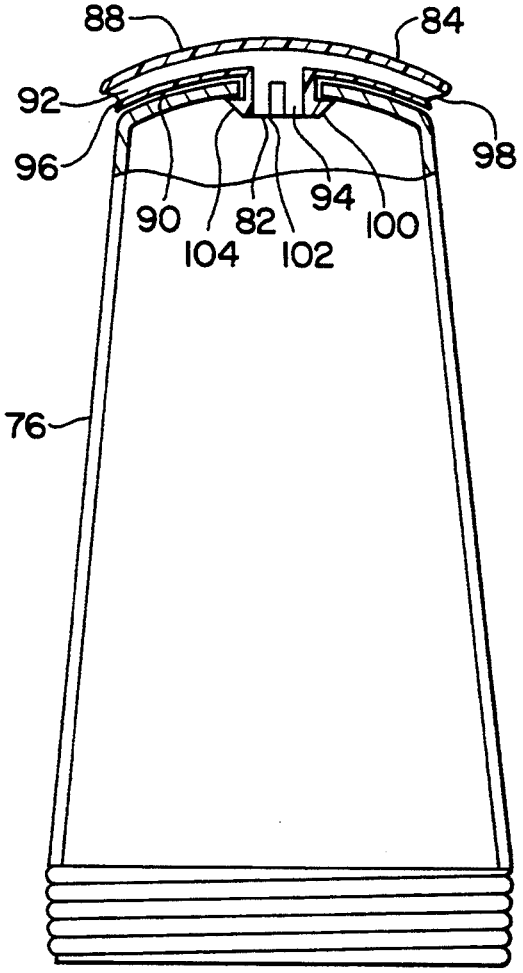
FIG. 5

FIG.16
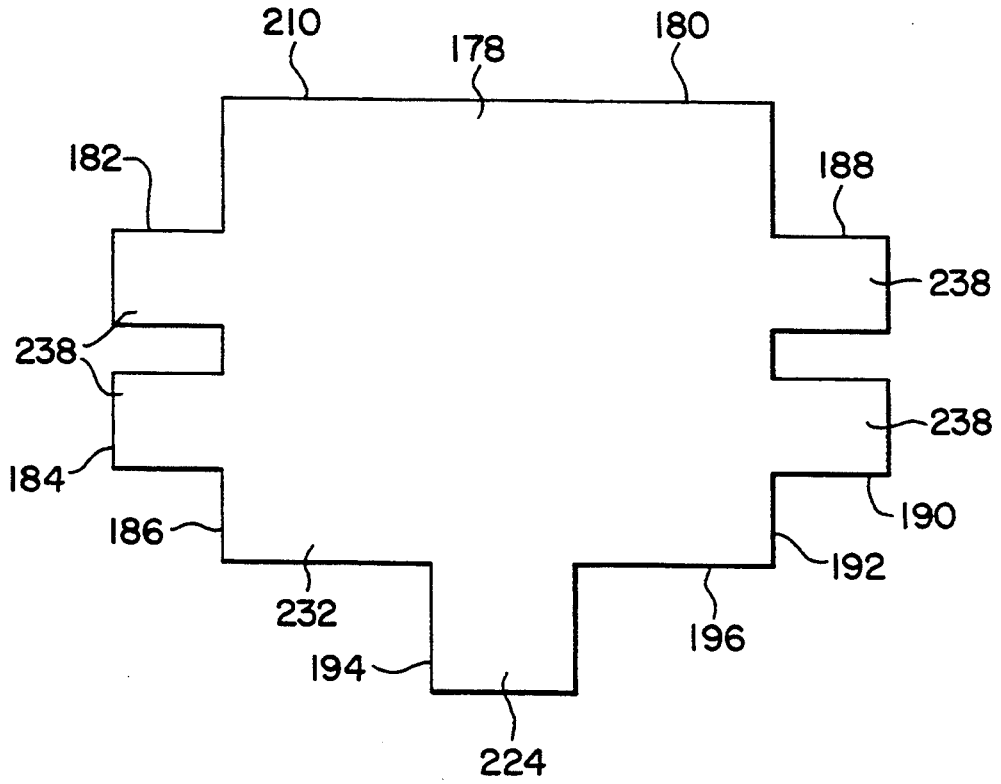
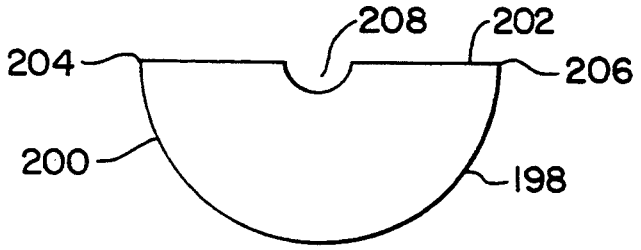
FIG.17
FIG.18
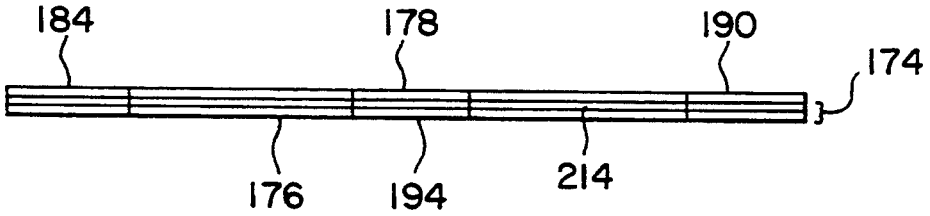

SELF-POSITIONING LAMP FIXTURE WITH STABILIZING BASE

BACKGROUND OF THE INVENTION

This invention relates to the field of self-righting lamp fixtures which have a structure that urges the fixture back toward its upright position when tilted away therefrom. In the event of inadvertent contact with the lamp fixture, instead of falling down and causing damage to the fixture the self-righting feature brings it back to its upright position.

Existing lamp fixtures for use at construction sites, camp grounds and other areas where a number of people are involved in active work or play, will normally fall over if accidentally hit. The fixture itself may be damaged. It may also cause damage to other things when knocked over. The present invention provides a solution to those problems by it's self-righting structure with a stabilizing base.

Prior art fixtures of various kinds have included self-righting features. Those known to the inventor include those which are disclosed in the following patents, including the inventor's own U.S. Pat. No. 5,134,555 disclosing a self-positioning lamp fixture.

U.S. Pat. No. 5,001,617 discloses a self balanced, multi position holder which includes structure that will hold the arm of the device at any angle at which it is positioned.

U.S. Pat. No. 4,739,302 discloses a road construction barrier or marker of frusto-conical configuration having a rounded portion near the bottom terminating in a flat bottom wall. The weighted portion or ballast is stated to be rigidly secured in the lower part of the base and is shaped in the form of a cone to produce the value and positioning of the center of gravity desired in that invention.

U.S. Pat. No. 4,117,455 discloses a self-righting roadway marking device having a rounded base of elastomeric material and an upright staff having a light bulb at the top. Wind vanes are secured to the staff to enable the wind to tip and rotate the lighted marking device on its rounded elastomeric base so as to attract more attention to the tipping and rotating light.

U.S. Pat. No. 4,028,543 discloses a baseless lamp fixture having an elongated tubular element with a light bulb at one end and a counterweight at the other, bent in such a way that an intermediate section of the elongated tubular element can be placed on a support member and the counterweight at one end will hold the light bulb at the other end in place.

U.S. Pat. No. 3,863,882 discloses a self balancing support for holding a book, magazine, newspaper or the like at a desired angle. Adjustable bags containing fluent material are connected to the box-like supporting structure having a back panel which can be manipulated in such a way as to hold the supporting structure and back panel at a desired position.

U.S. Pat. No. 1,439,101 discloses a traffic fixture having a pear shaped base, an upright member and a light fixture at the top. A plurality of legs are provided at the bottom to prevent the device from spinning or rotating on its longitudinal axis.

U.S. Pat. No. 1,228,615 discloses a self-righting guide post having a solid base with a slightly curved side wall, a convex top wall and a flat bottom wall, and a slender upright member extending upwardly from the base to which a flag may be attached, or to which a lamp fixture or light bulb may be secured.

U.S. Pat. No. 827,199 discloses a light fixture having a weighted base of generally triangular form.

U.S. Pat. No. 713,364 discloses a buoy having a pear shaped flotation member and a lamp fixture supported thereon, for connection to fishing nets to illuminate the nets and thereby attract fish.

U.K. Patent No. 313,174 discloses a lamp stand having a spherical base with a weight therein and an upright member with a light fixture at the top.

French Patent No. 714,784 discloses a table lamp having an upright support, a light bulb and lamp shade at the upper end, a small sphere or ball of rubber or the like at its lower end to rest on the surface of a table, a semi-circular shaft extending from the small sphere downwardly having a small weighted ball at the lower end of such semi-circular shaft.

Italian Patent No. 312,687 discloses lighting fixtures to outline airport runways which have a rounded base, an upright support member and a light fixture at the top. A battery or transformer is placed in the cavity of the rounded base to provide the electrical energy for the light bulb.

The self-positioning lamp fixture with stabilizing base in accordance with the present invention provides a number of improvements over those devices known to the prior art.

It provides a separate self-righting member or structure to which a separate lamp supporting assembly is connected by fastening screws around the peripheral edges of each component, and by an externally threaded filler neck of the self-righting member being received in the internally threaded recess of the lamp supporting assembly for threaded engagement therein.

The self-righting member is in the form of the segment of a sphere. In one embodiment it is completely solid. In a preferred embodiment it takes the form of a container, having a planar circular top wall lying in a plane which is coincident with or slightly below the equatorial plane of the sphere from which the segment comprising this invention is taken, a planar circular bottom wall lying in a plane below the top wall and above the adjacent pole of the longitudinal axis of such sphere which extends normal to its equatorial plane, and a continuously curved side wall having the same configuration as the corresponding segmented surface portion of such sphere.

Such spherical segment container has a cavity therein bounded by such top, bottom and side walls, opening to the filler passageway through the externally threaded filler neck. This embodiment of the self-righting member makes it possible to use fluid types of weighted material or ballast, such as sand which is poured through the filler neck to completely fill the cavity. The solid top, bottom and side walls of the container hold the sand in place when completely filled, so it does not shift when tilted and does not thereby shift the center of gravity.

Such construction enabling the use of fluid or ballast material has advantages over prior art devices, in that the lamp fixtures may be transported without the heavy ballast material in place. That can be poured into the spherical segment base on the job site or wherever the lamp fixture is to be used. Such construction also simplifies manufacture and sale of the lamp fixtures since the ballast materials can be added later and sold separately.

A closure cap may be provided to close the filler neck, or the roof of the internally threaded cavity of the lamp supporting assembly into which the externally threaded filler neck is screwed may constitute the closure cap to prevent fluid ballast material such as sand from flowing out of the filler neck when the device is tipped to one side.

The planar bottom wall of such spherical segment self-righting member stabilizes the fixture in the upright position. The particular construction in the form of a spherical segment as described herein assures that the center of gravity is below the equilibrium point so when tipped to one side the self-righting member will be rotated by gravitational forces back to its normal upright position.

The improved self-positioning lamp fixture in accordance with this invention provides an additional improvement over prior art devices in that it includes a shock absorbing mechanism for the light bulb socket assembly. A connecting band is provided around the side wall of the socket assembly, having radially extending flanges with apertures to receive one end of coil springs whose opposite ends are secured to the peripheral wall of the lamp supporting member, in the cavity of which the light bulb socket assembly is received. Any shock received by the wall of the lamp supporting member is thereby absorbed in whole or in part by the coil springs.

Further improvements over the prior art will become apparent from the detailed description which follows and from the accompanying drawings.

SUMMARY OF THE INVENTION

It is an object of the invention to provide an improved self-positioning lamp fixture in which the lamp supporting member and the self-righting member are separable components.

It is an object of the invention to provide an improved self-positioning lamp fixture requiring weighted material or ballast in which fluid ballast material such as sand may be used and may be put into the lamp fixture after sale and at the time it is to be used.

It is an object of the invention to provide an improved self-positioning lamp fixture in which the self-positioning member has a stabilizing base to stabilize the fixture in its upright position and a spherical segment configuration which assures the center of gravity is below the equilibrium point when it is filled with ballast material held uniformly dispersed throughout the interior volume of such self-positioning member.

It is an object of the invention to provide an improved self-positioning lamp fixture having a shock absorbing assembly to mount the light bulb socket member and protect it against shocks.

BRIEF DESCRIPTION OF THE DRAWING

FIG. 4 is an elevation view of one of the shock absorbing springs shown connected at one end to the cylindrical socket member, of which a broken away portion is shown, and at its opposite end to the cylindrical side wall of the elongated support section, of which a broken away portion is shown.

FIG. 5 is an elevation view of the light transmitting dome showing the vent cap on its top wall in section.

FIG. 16 is a plan view of the large flat substantially rectangular piece of sheet material which forms part of the flexible reflector hood, the outer side being shown.

FIG. 17 is a plan view of the semi-circular piece of sheet material to which the large substantially rectangular piece shown in FIG. 16 is sewn to form the flexible reflector hood, the outer side being shown.

FIG. 18 is an end view of the large substantially rectangular piece shown in FIG. 16, with the end somewhat enlarged to more clearly show each of the sheets of flexible material thereof.

DESCRIPTION OF PREFERRED EMBODIMENT

Figure 1:
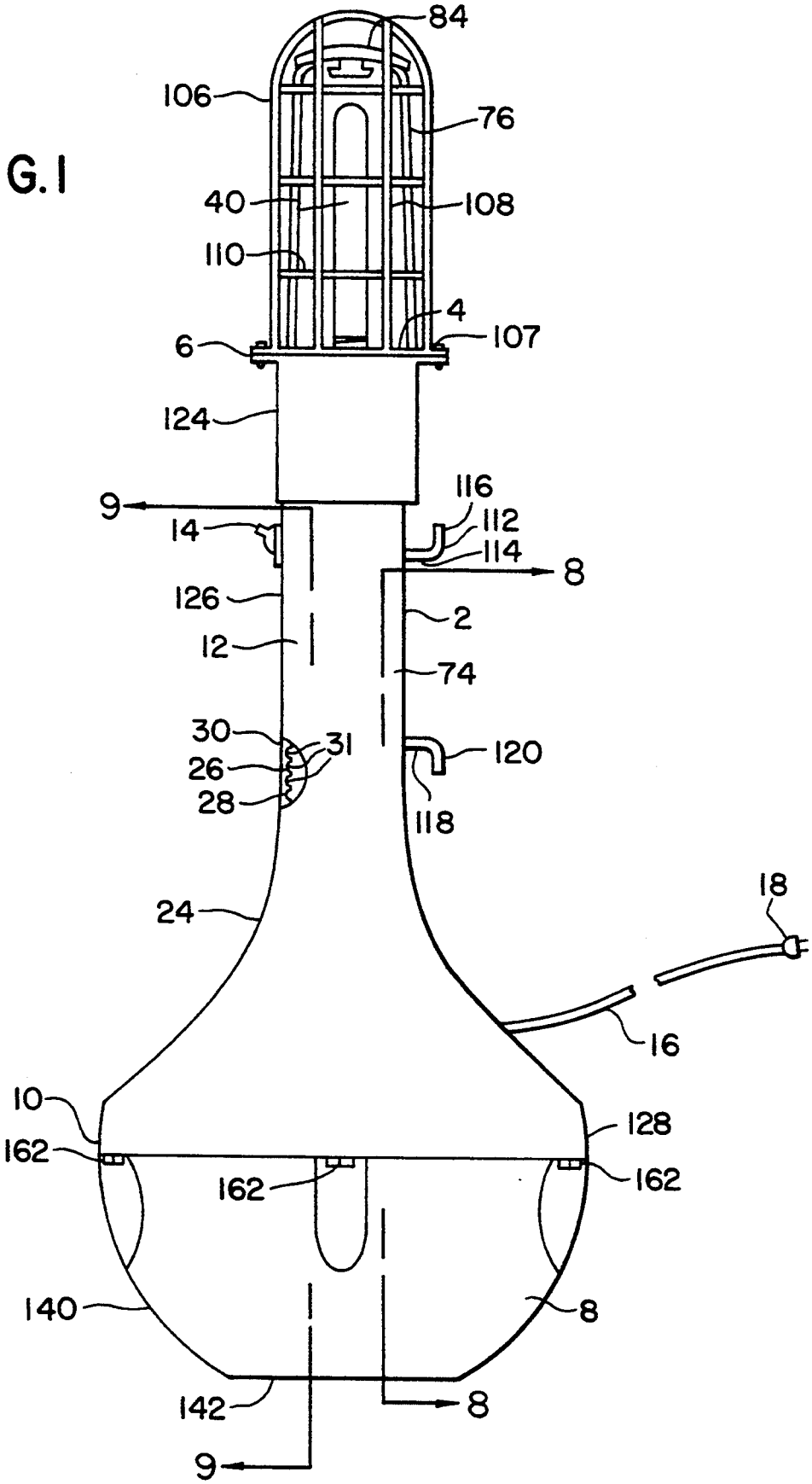
FIG. 1 is an elevation view of a self-positioning lamp fixture in accordance with this invention.
Figure 2:
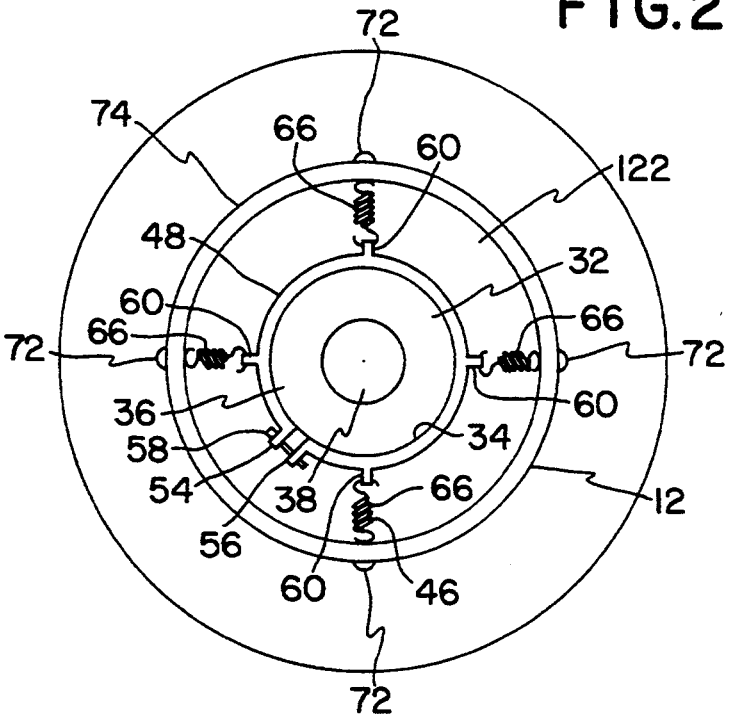
FIG. 2 is a plan view from the top of the elongated support section of the lamp fixture of FIG. 1, with the bulb, dome and protective cage removed.
Figure 3:
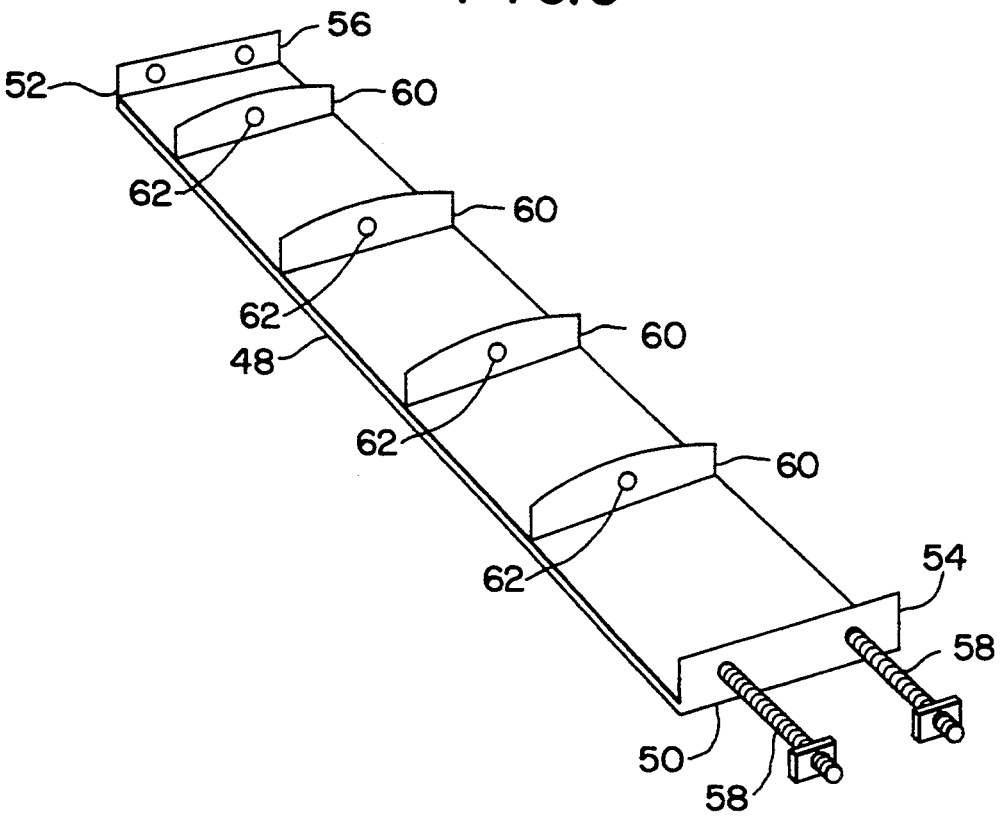
FIG. 3 is a perspective view of the connecting band which is wrapped around the cylindrical socket member for connecting of shock absorbing springs thereto.
Figure 6:
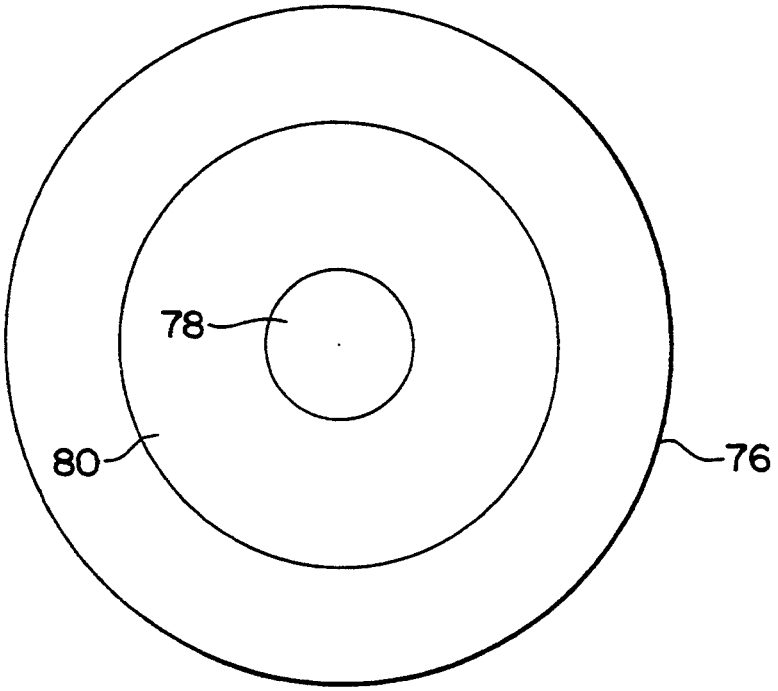
FIG. 6 is a top plan view of the dome of FIG. 5 with the vent cap removed to show its receiving aperture in the top wall.
Figure 7:
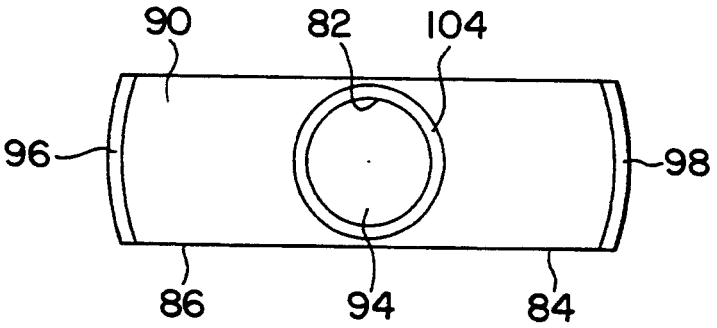
FIG. 7 is a bottom plan view of the vent cap.
Figure 8:
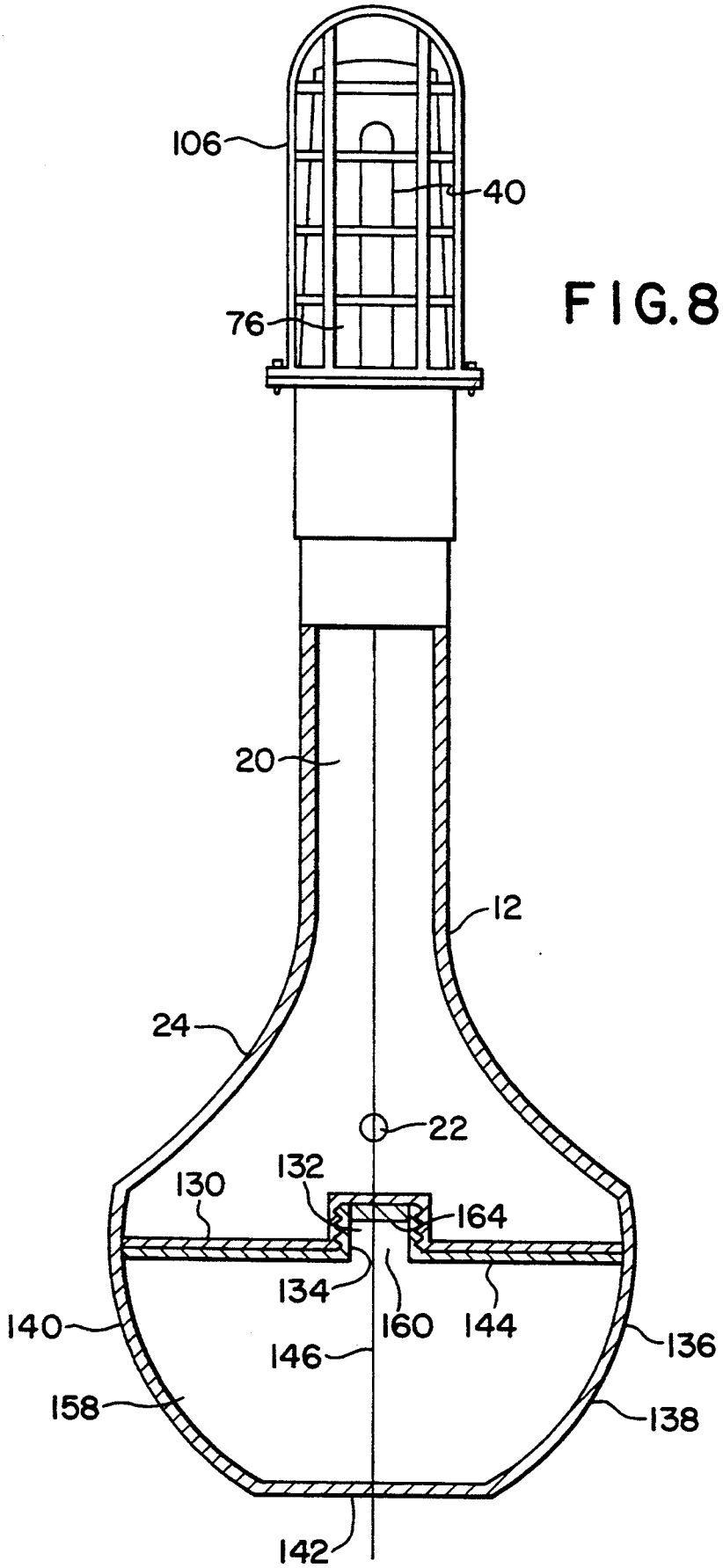
FIG. 8 is a section view taken on line 8—8 of FIG. 1.
Figure 9:
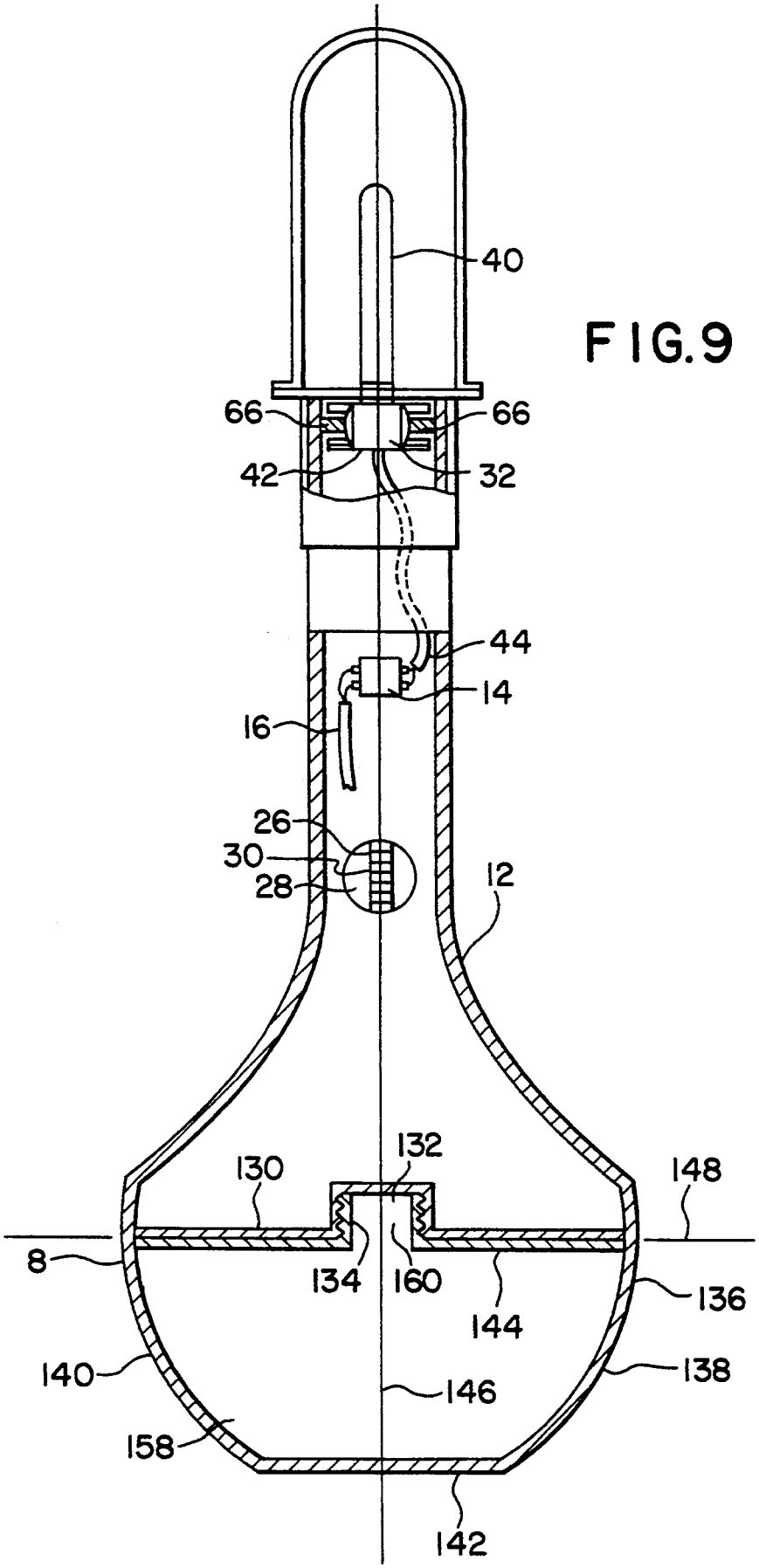
FIG. 9 is a section view taken on line 9—9 of FIG. 1.
Figure 10:
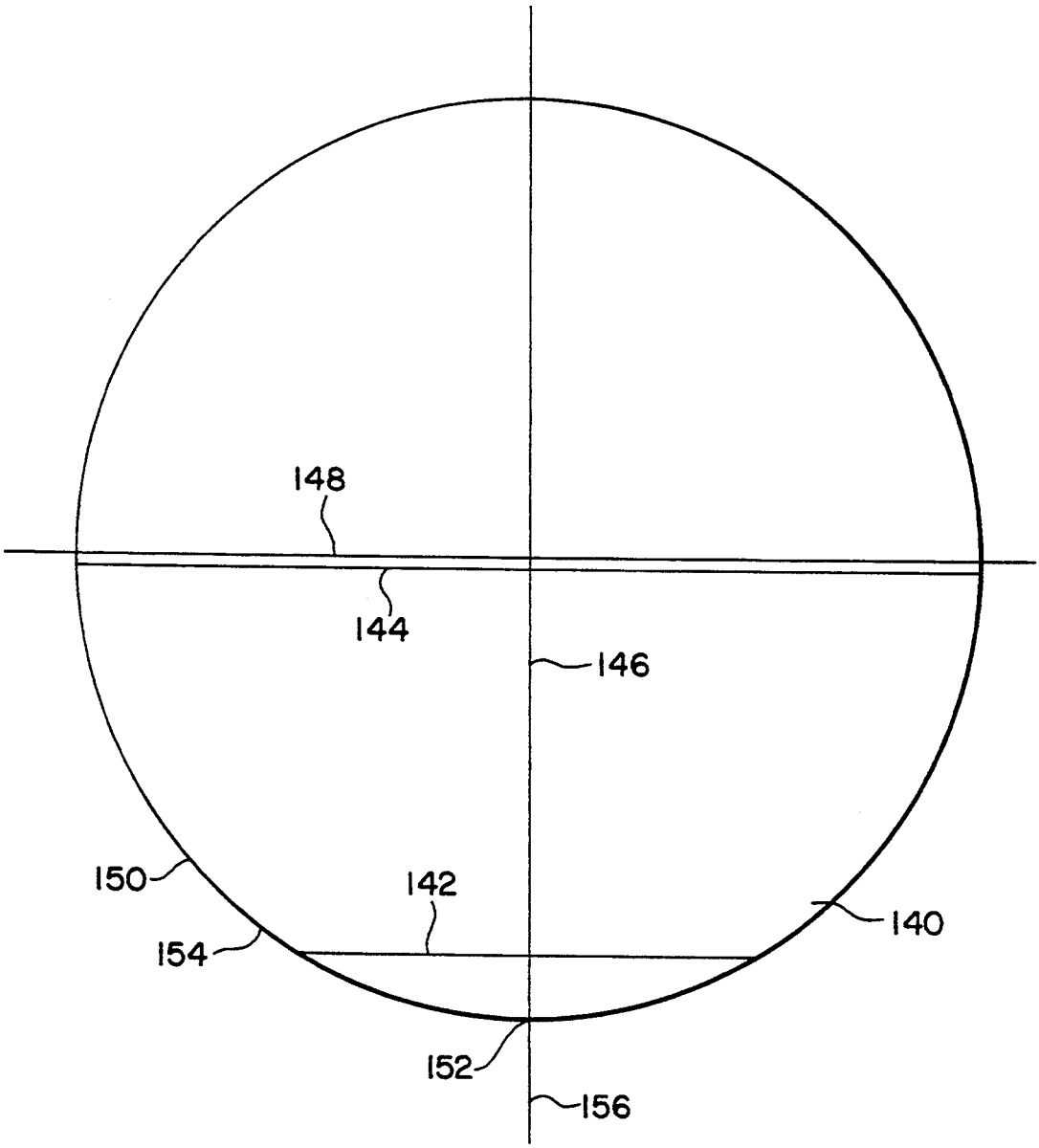
FIG. 10 is an elevation view of a sphere and a segment thereof which corresponds to the configuration of the self-positioning member of the lamp fixture in accordance with this invention.
Figure 11:
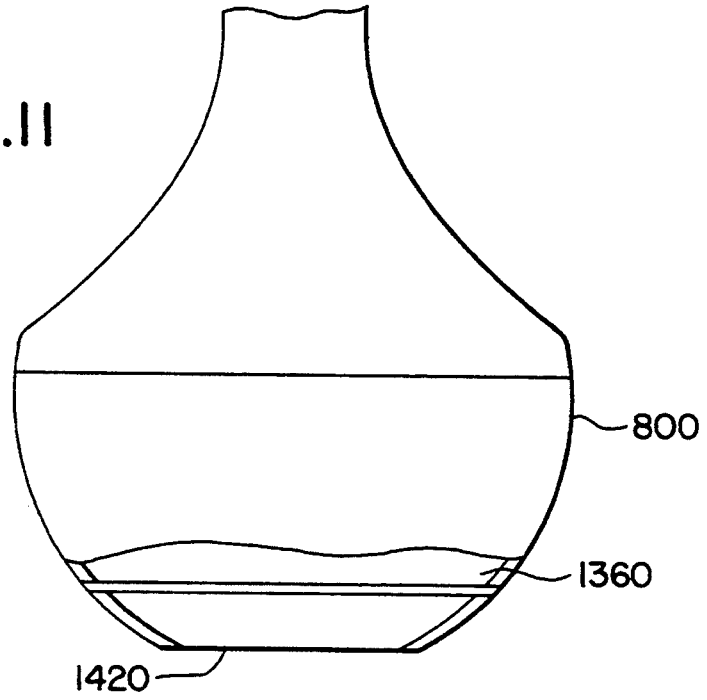
FIG. 11 is an elevation view of a modified embodiment of the lamp fixture in accordance with this invention, wherein the flat bottom wall is an open wall and the container to hold the ballast material is supported above the open bottom wall, the upper portion of the lamp fixture broken away and a portion of the arcuate side wall of the self-positioning member also broken away to show the bottom wall of the ballast container above the bottom open wall of the self-positioning member.
Figure 12:
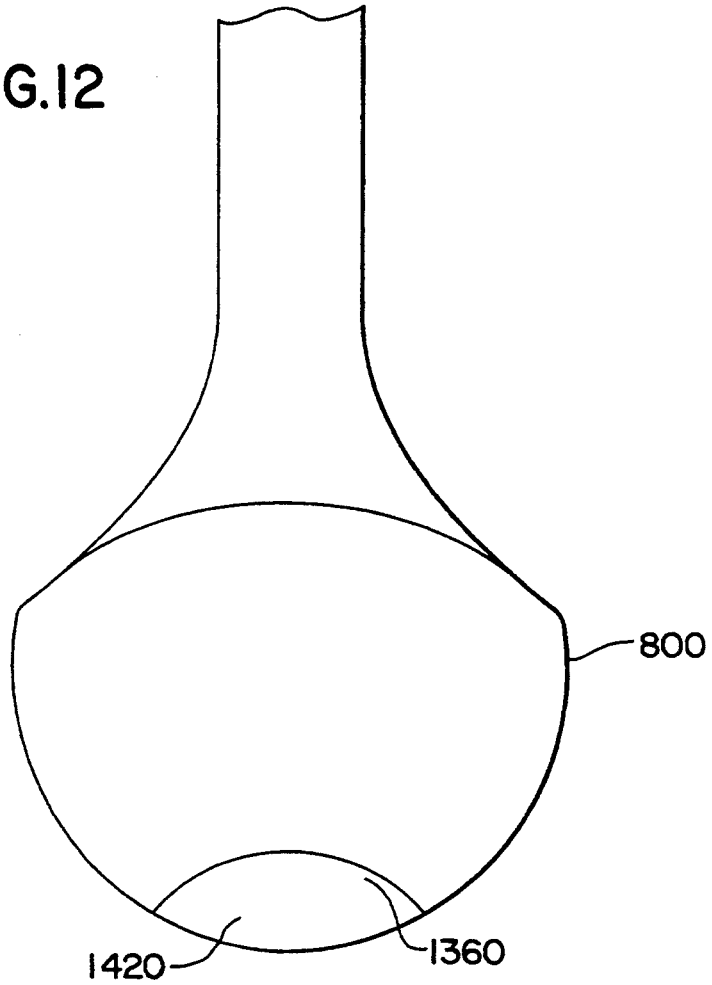
FIG. 12 is a perspective view of the modified embodiment of FIG. 11, showing the self-positioning member tipped far enough to one side to show the open bottom wall and a portion of the ballast container wall thereabove which can be partially seen through the open bottom wall of the self-positioning member.
Figure 13:
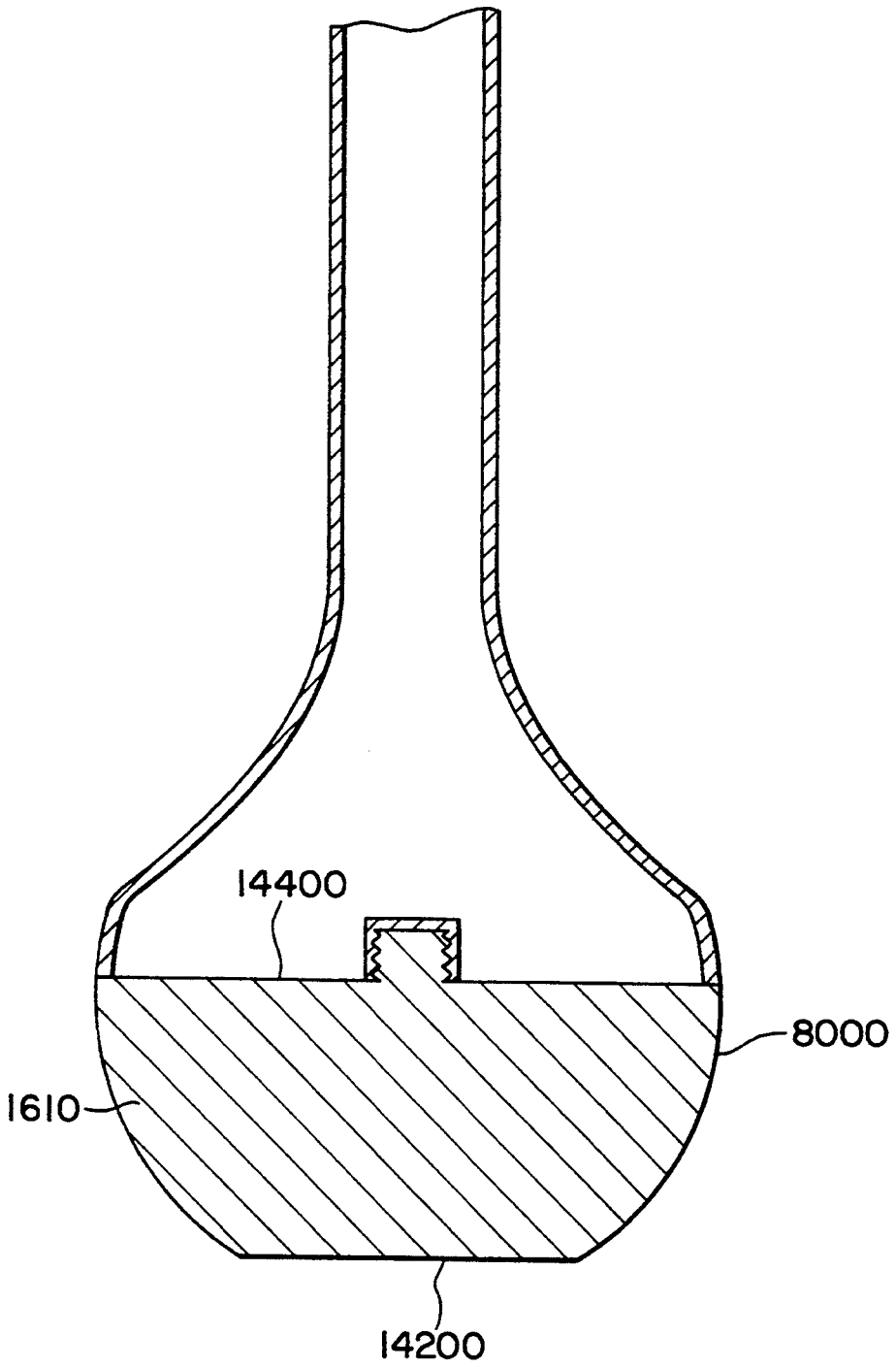
FIG. 13 is a section view of another modified embodiment of the lamp fixture in accordance with this invention, wherein the weighted ballast is integrally formed as part of the spherical segment structure which comprises the self-positioning member, the upper portion of the lamp fixture being broken away in this figure.
Figure 14:
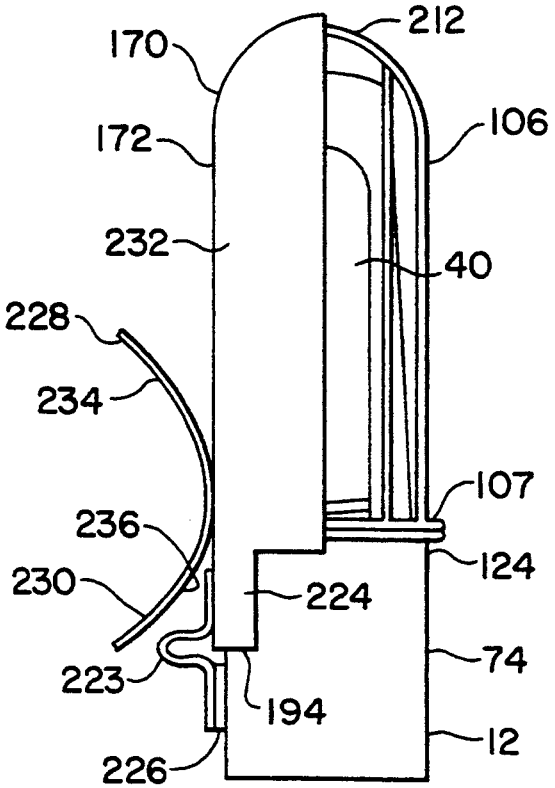
FIG. 14 is a side elevation view of the upper portion of the lamp fixture with a flexible reflector hood in accordance with this invention shown connected over the protective wire cage.
Figure 15:
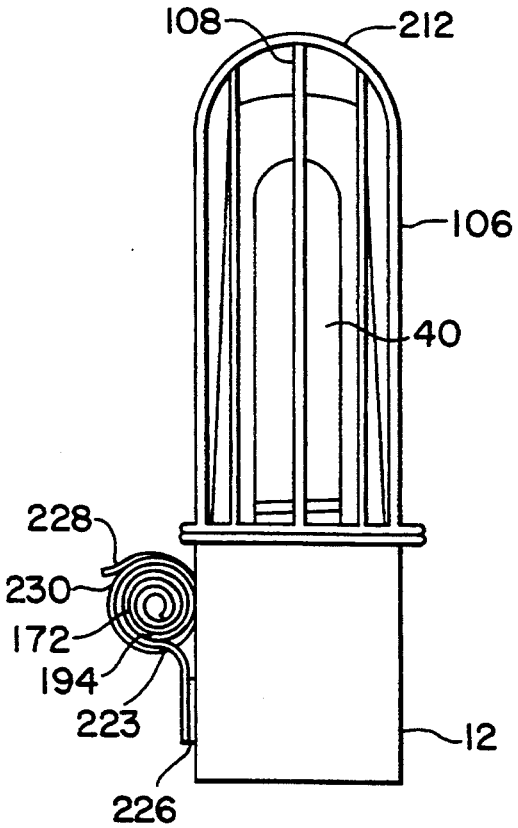
FIG. 15 is a side elevation view as shown in FIG. 14 but with the flexible reflector hood shown removed from the wire cage, rolled up and secured to the side wall of the lamp fixture.
Figure 19:
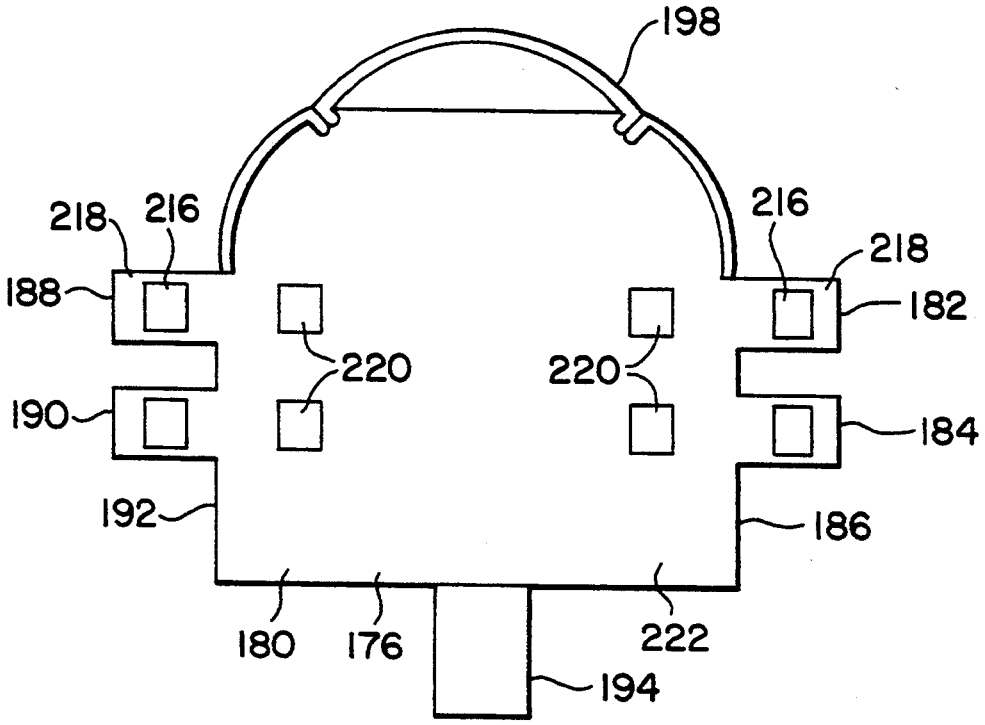
FIG. 19 is a plan view of the inner side of the flexible reflector hood with the substantially rectangular piece shown in FIG. 16 sewn to the semi-circular piece shown in FIG. 17.
Figure 20:
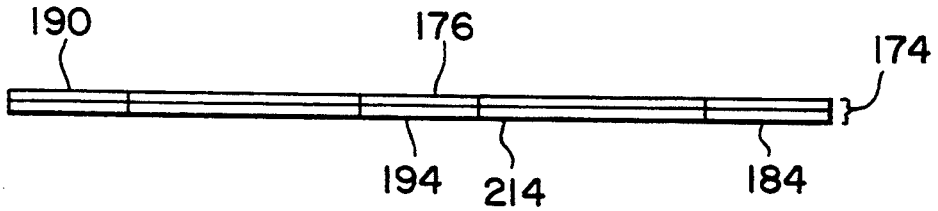
FIG. 20 is an end view of the inner layer of the flexible reflector hood showing the innermost stainless steel reflective foil and its adhesively secured backing sheet of fiberglass cloth.
Figure 21:
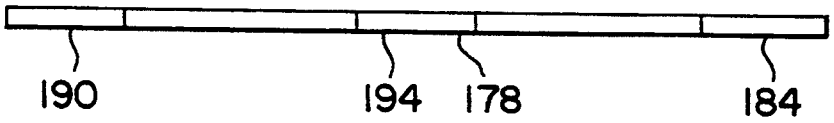
FIG. 21 is an end view of the outer layer of the flexible reflector hood comprising a sheet of fiberglass fabric impregnated with silicone rubber.
Figure 22:
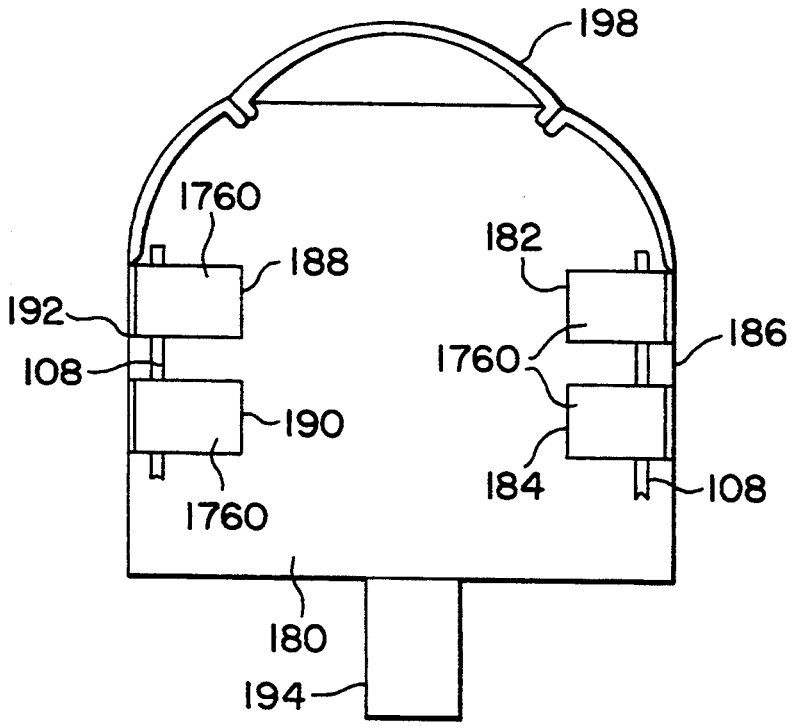
FIG. 22 is a plan view of the inner side of the flexible reflector hood as shown in FIG. 19 but with the cage connecting tabs shown folded inwardly to their fastening position to show the strips of stainless steel foil secured to the outer surfaces of the tabs which face inwardly toward the bulb when folded inwardly to their fastening position, broken away portions of the longitudinal protective bars of the wire cage being shown behind the tabs in their fastening position to illustrate how the flexible reflector hood is held in position over a semi-cylindrical half of the cage.

The self positioning lamp fixture in accordance with the present invention comprises an elongated support member 2 having a lamp assembly 4 at its upper end 6 and a self-righting or self-positioning structure 8 at its lower end 10.

An elongated support section 12 extends upwardly from the self-positioning structure 8 to the lamp assembly 4. An electrical switch 14 is mounted on the support section 12, and an electrical supply cord 16 is connected at one end to the switch 14 and at the opposite end to an electrical plug 18. The cord 16 extends from the switch 14 downward through the cavity 20 of the support section 12, and outward through an aperture 22 in the lower flared portion 24 of the support section 12.

A hand grasp 26 is provided on the elongated support section 12 comprising an aperture 28 large enough to receive four fingers of a user's hand, and a grip member 30 extending longitudinally across the aperture 28 having a plurality of arcuate indentations 31 facing inwardly of the cavity 20 having a dimension and configuration corresponding to that of the user's fingers when grasping the grip member 30.

The lamp assembly 4 at the upper end of the self-positioning structure 8 comprises a cylindrical socket member 32 of insulating material having a cylindrical side wall 34, a planar top wall 36, a socket 38 to receive a light bulb 40 therein which opens to the top wall 36, and a closed bottom wall 42. An electrical cord 44 extends from the switch 14 to the socket member 32 to electrically connect the socket 38 and light bulb 40 to the supply cord 16 through the switch 14 when in its contact closed position.

The socket member 32 is mounted at the upper end of the support section 12 by a shock absorbing assembly 46 to protect the light bulb 40 in socket 38 from damage when the lamp fixture in accordance with this invention is inadvertently bumped or hit while in use at construction sites, campgrounds and other places where it is exposed to inadvertent contact. The shock absorbing assembly 46 includes a circular band 48 wrapped around the cylindrical side wall 34 of the socket member 32, extending from a first end 50 of the band 48 to a second end 52. A first flange 54 extends radially outward from the first end 50 of the band 48. A second flange 56 extends radially outward from the second end 52 of the band 48. When the band 48 is wrapped around the cylindrical side wall 34 of the socket member 32, the first flange 54 faces the second flange 56 and is closely spaced apart therefrom. A tightening screw 58 extends through apertures in the flanges 54 and 56 for drawing the flanges toward each other and thereby tighten the grip of the circular band 48 around the socket member 32.

The circular band 48 includes four connecting flanges 60 spaced apart arcuately and equidistantly around the band 48, extending radially outward therefrom, each having an aperture 62 therethrough. One connecting end 64 of a coil spring 66 is received through the aperture 62 of each connecting flange 60, and the opposite connecting end 68 of each spring 66 is received through the aperture 70 of an anchor pin 72 extending through the cylindrical side wall 74 of the support section 12 near its upper end. Four coil springs 66 are provided for connection to the four connecting flanges 60, and four anchor pins 72 are provided at correspondingly spaced apart locations around the cylindrical side wall 74, extending therethrough, for connection to the four coil springs 66.

When the coil springs 66 are connected between the connecting flanges 60 and corresponding anchor pins 72 they are under tension, each exerting a bias on the socket member 32 in the direction radially outward toward the cylindrical side wall 74 of the support section 12 at equally spaced apart arcuate distances around its cylindrical wall 34. Any shock transmitted to the side wall 74 of the support section 12 is thereby largely absorbed by the springs 66 and is not transmitted with full force to the socket member 32 and bulb 40 in the socket 38 thereof.

The socket member 32 and 38 as shown and described herein hold a halogen bulb 40 which extends upwardly from the socket member 32. A transparent dome 76, of glass or other appropriate light transmitting material, is connected to the upper end of the support section 12 and extends upwardly therefrom to enclose the bulb 40. The dome 76 has an aperture 78 through its top wall 80 to receive the cylindrical wall insert 82 of a vent cap 84. The vent cap comprises a substantially rectangular panel 86 having a slightly curved upper surface 88 and a spaced apart correspondingly curved lower surface 90 with an air passageway 92 therebetween in communication with the passageway 94 through the cylindrical wall of the vent cap insert 82 which opens to the interior of the glass dome 76. The air passageway 92 opens at each opposite end 96 and 98 of the vent cap panel 86, thereby venting the interior of the glass dome 76 enabling escape of gases therein as they become heated and expand when the bulb 40 is lit.

The cylindrical wall insert 82 of the vent cap 84 is of compressible material and includes a radially extending annular flange 100 around its lower edge 102. The annular flange 100 has a cam surface 104 which engages the inner circumference of the dome aperture 78 when insert 82 is positioned for insertion therein, and as downward pressure is applied the cam surface compresses the annular flange 100 radially inward a sufficient distance to pass through the aperture 78, after which the annular flange 100 snaps back to its original position thereby holding the vent cap in place on the top wall of the glass dome 76.

A wire cage 106 is mounted over the dome 76 having its lower end 107 secured to the upper circumferential edge of the support section 12. The wire cage 106 has a plurality of longitudinally extending protective bars 108 spaced apart radially around the circumference of the cage 106, and a plurality of annular protective bars 110 spaced apart longitudinally of the cage 106, to protect the dome 76 from damage.

A coil keeper bracket 112 is provided on the side wall of the support section 12, comprising a first projecting arm 114 having one end secured to the side wall of support section 12 and an upwardly extending lug 116 at its opposite free end, and a second projecting arm 118 spaced apart below the first projecting arm 114 having one end secured to the side wall of support section 12 and a downwardly extending lug 120 at its opposite free end.

The support section 12 terminates in an open top wall 122 at its upper end 124. The support section 12 extends downwardly in a relatively small diameter cylindrical stem portion 126 where it is integrally joined with the outwardly flared portion 24 near the bottom end 128 of support section 12.

A solid circular and planar bottom wall 130 extends across the bottom of the support section 12, having a central cavity 132 to receive the upwardly projecting cylindrical neck 134 of the self-positioning structure 8.

The self-positioning structure 8 comprises a self-righting container 136 having an exterior side wall 138 which comprises a spherical segment 140, a solid circular and planar bottom wall 142 and a solid circular and planar top wall 144 extending radially outwardly from the centrally positioned and upwardly projecting cylindrical neck 134.

The bottom wall 142 has a smaller diameter than that of the top wall 144. The bottom wall 142 lies in a plane that is parallel to the plane in which the top wall 144 lies and is spaced apart therefrom. The spherical segment 140 has a central axis 146 which extends normal to both the bottom wall 142 and top wall 144 of the self-righting container 136 and through the center of each. The spherical segment 140 is defined as a segment taken between the equatorial plane 148 of a sphere 150 and the pole 152 of that sphere nearest such segment located on its surface 154 at which its axis 156 that is normal to the equatorial plane 148 intersects the surface 154. Thus, the top wall 144 of the spherical segment 140 is coincident with or spaced apart from the equatorial plane 148 in the direction toward the pole 152 but closer to the equatorial plane than the bottom wall 142 which is spaced apart from the pole 152 in the direction toward the equatorial plane 148 but closer to the pole 152 than the top wall 144.

The side wall 138 of the self-righting container 136 is thereby continuously curved throughout its extent between the bottom wall 142 and top wall 144, and it bounds a cavity 158 which extends between the bottom wall 142 and top wall 144. The cavity 158 opens to a cylindrical passageway 160 through the cylindrical neck 134 to receive sand 161 or other weighted material to fill the cavity 158 therewith from the top wall 144 to the bottom wall 142. When the cavity is thus filled, the center of gravity of the self-righting container 136 is below the top wall 144 thereof, above the bottom wall 142 thereof, and substantially coincident with the central axis which extends between the center of the top wall 144 and the center of the bottom wall 142. With the center of gravity at such location, gravitational forces will tend to rotate such spherical segment 140 until the top wall 144 and bottom wall 142 are substantially horizontal, with the top wall 144 above the bottom wall 142 and the central axis 146 of the spherical segment is substantially vertical.

By virtue of such construction, when the self-righting container 136 is tipped on to its continuously curved side wall 138, gravitational forces alone will cause the container 136 to rotate back to a position where the bottom wall 142 rests on a horizontal surface. The elongated support section 12 affixed to the self-righting container 136 of the self-positioning structure 8 is thereby brought back to and held in the vertical position, along with the lamp assembly 4 affixed to the upper end 6 of the self positioning lamp fixture in accordance with this invention.

The self-righting container 136 is affixed to the support section 12 by four screws 162 at equidistant arcuately spaced apart locations around the top wall 144 of the self-righting container 136 and of the bottom wall 130 of the support section 12, which extend through both walls to securely join the self-righting container 136 to the support section 12.

The cylindrical neck 134 which extends upwardly from the center of the top wall 144 of the container 136 has a closure cap 164 to close the entrance to the cylindrical passageway 160 when the cavity 158 has been filled with sand or other appropriate weighted material. The sand or other weighted material which fills the cavity 158 is prevented from shifting within the cavity when it is filled by the solid top wall 144, solid bottom wall 142 and solid continuously curved side wall 138 which bounds the cavity 158. Other means can be provided to hold the weighted material from shifting and from thus changing the center of gravity. This invention makes it possible to use weighted materials which are fluid, such as sand, for the ballast needed to provide the fixed self-righting center of gravity which will return the self-righting container 136 and lamp fixture of which it is a part to the upright position in the event it is tipped away therefrom.

The cylindrical neck 134 extending upwardly from the top wall 144 of the spherical segment container 136 is externally threaded. The central cavity 132 of the bottom wall 130 of the support section 12 is internally threaded to receive and hold the cylindrical neck 134 in threaded engagement therein. The support section 12 is held to the self-righting structure 8 comprising the spherical segment container 136 by this threaded connection in addition to the four connecting screws 162.

In a modification of this invention, the self-righting structure 800 may have an open bottom wall 1420 and a ballast container 1360 which is positioned above the plane of the open bottom wall 1420 and which extends below the plane of the top wall 1440.

It is within the scope of this invention to use ballast or weighted material 1610 which is not fluid, but which comprises a solid mass. Such solid ballast or weighted material 1610 may in fact be integrally formed as part and parcel of the self-righting structure 8000 extending between the top wall 14400, the bottom wall 14200 and the continuously curved side wall 13800 of the spherical segment 14000.

A reflector 170 in the form of a flexible hood 172 is provided for placing over a semi-cylindrical half of the wire cage 106, to reflect light from the bulb 40 out through the opposite open half of the wire cage 106.

The reflector hood 172 comprises an inner composite layer 174 of flexible sheet material having an inwardly facing coating of stainless steel foil 176 with a backing of fiber glass cloth, and an outer layer 178 of flexible sheet material which is waterproof and oil resistant and substantially non-flammable. The inner and outer layers 174 and 178 are superimposed one over the other. The hood 172 comprising inner layer 174 and outer layer 178 is made of two pieces joined together along abutting edges. The first is a large flat substantially rectangular piece 180 having a first pair of cage connecting tabs 182 and 184 projecting outwardly from one side edge 186, a second pair of cage connecting tabs 188 and 190 projecting outwardly from the opposite side edge 192, and a fixture connecting tab 194 projecting downwardly from the bottom edge 196. The second piece of the hood 172 is a flat semi-circular piece 198, having a semi-circular edge 200 with a straight edge 202 extending across from the first end 204 of the semi-circular edge 200 to its second end 206, with a small semi-circular recess 208 extending inwardly from the straight edge 202 at its midpoint.

The first large substantially rectangular piece 180 is stitched, or sewn, or otherwise secured along its upper edge 210 to the semi-circular edge 200 of the second semi-circular piece 198. The lineal dimension of the straight upper edge 210 of the first piece 180 and the lineal dimension of the semi-circular edge 200 of the second piece 198 are substantially equal. When secured together, the straight upper edge 210 of the first substantially rectangular piece 180 forms a semi-circle around the semi-circular edge 200 of the second semi-circular piece 198, and such second semi-circular piece 198 then extends in a direction that is transverse to the first flat substantially rectangular piece 180, almost perpendicular or normal thereto. The upper portion of the first piece 180 adjacent its upper edge 210 begins to curve radially inwardly as it extends toward the junction of the upper edge 210 and the semi-circular edge 200 of the second piece 198.

The lineal dimension of the upper edge 210 of the first piece 180 and of the semi-circular edge 200 of the second piece 198 is substantially the same as the lineal dimension of one half the circumference around the wire cage 106. The lineal dimension between the upper edge 210 and the bottom edge 196 of the first piece 180 is substantially the same as the vertical dimension between the top 212 of the wire cage 106 and its lower end 107. Thus when the two pieces 180 and 198 of the flexible reflector hood 172 are sewn or otherwise connected together as described, the reflector hood 172 forms a semi-cylindrical hood structure that fits over a semi-cylindrical half of the wire cage 106.

The flexible sheet inner layer 174 of the reflector hood 172 has its coating of stainless steel foil 176 facing inwardly in a semi-circle of the wire cage 106 when affixed thereto, to reflect light from the bulb 40 outwardly through the opposite semi-cylindrical half of the wire cage 106 not covered by the reflector hood 172. The inner layer 174 includes a sheet of heavy weight, plain weave, fiberglass cloth 214 to which the sheet of stainless steel foil 176 is laminated on one side by a special high temperature adhesive with heat, chemical and moisture resistance. The inner layer 174 has a temperature resistance up to plus 500 degrees Fahrenheit, is flame resistant, and has substantial tensile, tear and burst strength. A suitable sheet material for the inner layer 174 is available from Alpha Associates, Inc. of Woodbridge, N.J. identified as Alpha Maritex Style 2025/9480 ST-HT.

The outer layer 178 of the reflector hood 172 overlays the fiberglass cloth 214 of the inner layer 174 on the side opposite from its inwardly facing sheet of stainless steel foil 176, and is affixed to the inner layer 174 by sewing around the outer edges, or by any other convenient method. The outer layer 178 comprises a flexible sheet of fiberglass fabric impregnated with silicone rubber which is water and oil resistant, flame retardant, can be easily sewn, is lightweight, has substantial tensile, tear and burst strength and is useable throughout a temperature range from minus 67 degrees Fahrenheit up to plus 500 degrees Fahrenheit for 1,000 hours on a continuous basis with no change in its material characteristics, and up to plus 700 degrees Fahrenheit for 100 hours on an intermittent basis with minimum weight loss and 50% strength loss.

A suitable sheet material for the outer layer 178 is also available from Alpha Associates, Inc. of Woodbridge, N.J. identified as Alpha Maritex Style 3259-2-SS which meets U.S. Military Specification MIL-C-20079P and Military Specification MIL-1-24244.

The reflector hood 172 is affixed to the wire cage 106 by folding the cage connecting tabs 182 and 184 on side edge 186 around one of the longitudinal bars 108 at one side of the wire cage 106, and folding the cage connecting tabs 188 and 190 on the opposite side edge 192 around one of the longitudinal bars 108 at the opposite side of the wire cage 106. A first cage fastening member 216 is secured to the inner side 218 of each of the cage connecting tabs 182, 184, 188 and 190, and a second cooperative cage fastening member 220 is secured to the inner side 222 of the rectangular piece 180 from which the cage connecting tabs extend. When the cage connecting tabs are folded around their respective longitudinal bars 108 of the wire cage 106, the first cage fastening member 216 of each cage connecting tab is in registration with the second cooperative cage fastening member 220 for fastening engagement therewith.

As shown and described herein, the first cage fastening member 216 comprises a strip of fabric material having small hook end projections extending outwardly and the second cooperative cage fastening member 220 comprises a strip of fabric material having small loops or other hook end retaining structures extending therefrom to be hooked by and to releasably hold the small hook end projections of the first cage fastening member 216 when brought into contact therewith. Other fastening means such as snaps may also be used.

The flexible reflector hood 172 is secured to the upper portion of the cylindrical side wall 74 of the elongated support section 12 of the lamp fixture by a first fixture fastening member 223 secured to the outer surface 224 of the fixture connecting tab 194, and a second cooperative fixture fastening member 226 secured to the outer cylindrical side wall 74 of the elongated support section 12 near its upper end 124. The first fixture fastening member 223 is in registration with the second cooperative fixture fastening member 226 when the flexible reflector hood 172 is in place on the wire cage 106.

As shown and described herein, the first fixture fastening member 223 comprises a strip of fabric material having small hook end projections extending outwardly and the second cooperative fixture fastening member 226 comprises a strip of fabric material having small loops or other hook end retaining structure extending therefrom to be hooked by and to releasably hold the small hook end projections of the first fixture fastener member 222 when brought into contact therewith. Other fastening means such as snaps may also be used.

When the flexible reflector hood 172 is removed from the wire cage 106, it may be folded from its upper end downwardly. The folded or rolled up hood may then be held in its folded or rolled up position by the securing straps 228 and 230 which are secured to the outer side 232 of the outer layer 178 of sheet material which makes up the flexible reflector hood 172, at a point thereon about level with the bottom edge 196, equidistant from each side edge 186 and 192, and just above the downwardly extending fixture connecting tab 194.

The upper securing strap 228 has a continuous length of fabric material with small loops extending therefrom on its outwardly facing side 234. The lower securing strap 230 has a continuous length of fabric material with small hook end projections extending therefrom on its inwardly facing side 236. The securing straps are brought around the flexible reflector hood 172 when in its folded or rolled up position, with the outwardly facing side 234 of the upper strap 228 in registration with the inwardly facing side 236 of the lower strap 230 whereupon the hook end projections of the lower strap 230 engage and are releasably held by the loops extending from the upper strap 228.

The rolled up flexible reflector hood 172 may be held to the lamp fixture while in its rolled up position by its fixture connecting tab 194 held to the cylindrical side wall 74 of the fixture by the fixture fastening members 223 and 226.

The cage connecting tabs 182, 184, 188 and 190 each have a strip of stainless steel foil 1760 on their outwardly facing surfaces 238, so when folded around the longitudinal bars 108 of the wire cage 106 to the fastening position of said tabs, at which time the outwardly facing surfaces 238 are then facing radially inwardly toward the bulb 40, they have reflective surfaces which match the reflective surface of the stainless steel foil 176 which covers the rest of the inwardly facing surface of the inner layer 174 of the flexible reflector hood 172.

The surfaces of the stainless steel foil 176 and stainless steel foil strips 1760 are shiny and reflect light from the bulb 40. It is an important advantage of this invention to provide a flexible reflector for self-positioning lamp fixtures used on construction sites, camp grounds and the like, which may be rolled up when not in use and still retained on the fixture, and which is weatherproof, heat resistant, flame resistant as well as durable having strong tensile, tear and burst characteristics for use in almost any kind of environment.

I claim:

1. A self-positioning lamp fixture, comprising an elongated structure to be supported in a vertical position on a horizontal surface, said elongated structure including self-positioning means to position said elongated structure in said vertical position when placed on a said horizontal surface and to return it to said vertical position when tipped away therefrom, a lamp supporting structure extending from said self-positioning means, said self-positioning means including a segment of a sphere taken between the equatorial plane of said sphere and the pole of said sphere nearest said segment lying on the axis of said sphere which extends normal to said equatorial plane and from the center thereof, said segment having an upper wall and a lower wall, said upper wall lying in a plane which is closer to said equatorial plane than said lower wall, said segment having a planar lower wall spaced apart above said pole of said sphere and below said upper wall, said lower wall of said segment lying in a plane which extends transverse to said axis of said sphere, said lower wall of said segment providing stabilizing means for said lamp fixture to stabilize it in said vertical position when said lower wall is placed on a said horizontal surface, said segment having a continuously curved side wall extending between said upper wall and said lower wall, said segment including ballast means to counter-balance the weight of said lamp supporting structure extending from said self-positioning means.

2. A self-positioning lamp fixture as set forth in claim 1, wherein said lower wall of said segment is an open wall, said ballast means being carried by said segment above said lower wall.

3. A self-positioning lamp fixture as set forth in claim 1, wherein said lower wall is imperforate throughout.

4. A self-positioning lamp fixture as set forth in claim 1, wherein said upper wall, side wall and lower wall of said segment are solid and define a cavity bounded thereby, said ballast means comprising fluid material which completely fills said cavity, said upper wall, side wall and lower wall of said cavity holding said fluid material in place to substantially prevent shifting the center of gravity within said cavity.

5. A self-positioning lamp fixture as set forth in claim 1, wherein said lamp supporting structure includes an elongated body portion having a cross-sectional dimension smaller than that of said upper wall of said segment said elongated body portion extending upwardly and terminating in an upper end, a lamp socket assembly mounted at said upper end of said elongated body portion, and shock absorbing means securing said lamp socket assembly to said upper end of said elongated body portion to absorb any shocks transmitted to said body portion and to substantially prevent them from being transmitted to said lamp socket assembly and a lamp bulb received therein.

6. A self-positioning lamp fixture as set forth in claim 5, wherein said upper end of said elongated body portion comprises a cylindrical side wall bounding a cylindrical cavity, said lamp socket assembly includes a cylindrical body of electrically insulating material having an upwardly facing top wall, a bulb receiving socket opening to said top wall of said cylindrical body of electrically insulating material, the diameter of said cylindrical body of said lamp socket assembly being smaller than that of said cylindrical cavity bounded by said cylindrical side wall of said upper end of said elongated body portion, said cylindrical body of said lamp socket assembly being received in said cylindrical cavity of said upper end of said elongated body portion, an annular space between said cylindrical body of said lamp socket assembly and said cylindrical side wall of said upper end of said elongated body portion, and a plurality of springs extending across said annular space connected between said cylindrical side wall of said upper end of said elongated body portion and said cylindrical body of said lamp socket assembly to hold it in place within said cylindrical cavity.

7. A self-positioning lamp fixture as set forth in claim 6, including a band around said cylindrical body of said lamp socket assembly, a first flange projecting outwardly from said band having a first aperture therein, a second flange projecting outwardly from said band having a second aperture therein arcuately spaced apart ninety degrees from said first flange, a third flange projecting outwardly from said band having a third aperture arcuately spaced apart ninety degrees from said second flange, and a fourth flange projecting outwardly from said band having a fourth aperture arcuately spaced apart ninety degrees from said third flange, said plurality of springs includes a first spring having one end connected to said first aperture of said first flange, a second spring having one end connected to said second aperture of said second flange, a third spring having one end connected to said third aperture of said third flange, and a fourth spring having one end connected to said fourth aperture of said fourth flange, said springs each having respective opposite ends connected to said cylindrical side wall of said upper end of said elongated body portion.

8. A self-positioning lamp fixture as set forth in claim 5, including a transparent dome extending upwardly from said upper end of said elongated body portion to enclose a bulb received in said lamp socket assembly, an aperture through said dome at an upper end portion thereof, a vent cap assembly having an insert portion received in said aperture of said dome, said vent cap assembly having a vented panel portion extending radially outwardly from said insert portion which lies outwardly of and adjacent to said dome when said insert portion is received in said aperture of said dome, and an air passageway through said insert portion and said vented panel portion to vent heated air from inside said dome to the outside.

9. A self-positioning lamp fixture as set forth in claim 8, wherein said insert portion of said vent cap assembly includes a cylindrical side wall extending from said vented panel portion and terminating at a free end which extends beyond the wall of said dome when received in said aperture of said dome, an annular rib extending outwardly around said free end of said cylindrical side wall of said insert portion, a cam surface on said annular rib facing outwardly thereof to contact the peripheral edge of said aperture of said dome and compress the cylindrical side wall of said insert portion sufficiently to pass through said aperture whereupon said annular rib snaps back to hold said vent cap assembly in place on said dome.

10. A self-positioning lamp fixture as set forth in claim 9, including a protective cage mounted over said dome, said cage comprising a plurality of annular protective bars spaced apart upwardly thereof and a plurality of longitudinal protective bars spaced apart radially thereof.

11. A self-positioning lamp fixture as set forth in claim 5, wherein said elongated body portion of said lamp supporting structure includes hand grasp means comprising a hand grasp aperture opening to a cavity in said elongated body portion large enough to receive a plurality of fingers of a user's hand, and a longitudinally extending grip member extending across said hand grasp aperture.

12. A self-positioning lamp fixture as set forth in claim 11, wherein said grip member includes a plurality of arcuate indentations corresponding in dimension and configuration to that portion of a user's fingers which grasps such grip member.

13. A self-positioning lamp fixture as set forth in claim 5, including a switch mounted on said elongated body portion of said lamp supporting structure, a first electrical cord extending from said switch to said lamp socket assembly within the interior of said elongated body portion, a second electrical cord extending from said switch within the interior of said elongated body portion to a cord exit aperture and outwardly thereof to terminate in an electric plug.

14. A self-positioning lamp fixture as set forth in claim 5, including a cord keeper bracket on said elongated body portion of said lamp supporting structure, said cord keeper bracket comprising a first support arm extending outwardly from said elongated body portion terminating at an outer free end and having a lug extending upwardly therefrom, a second support arm extending outwardly from said elongated body portion spaced apart downwardly from said first support arm terminating at an outer free end and having a lug extending downwardly therefrom.

15. A self-positioning lamp fixture as set forth in claim 5, wherein said lamp supporting structure includes an outwardly flared portion extending downwardly from said elongated body portion and terminating in a circular peripheral edge having a dimension and configuration corresponding to the peripheral edge of said upper wall of said segment of said sphere comprising said self-positioning means, said lamp supporting structure having a planar bottom wall, a central aperture therein opening to an internally threaded cylindrical cavity extending upwardly of said bottom wall of said lamp supporting structure and inwardly thereof, said upper wall of said segment being planar and having an externally threaded filler neck extending upwardly from the center of said upper wall to be threadedly received in said internally threaded cavity of said lamp supporting structure to thereby secure said segment of said sphere comprising said self-positioning means to said lamp supporting structure.

16. A self-supporting lamp fixture as set forth in claim 15, wherein said upper wall, side wall and bottom wall of said segment of said sphere are imperforate and define a cavity within said segment, a passageway through said filler neck opening to said cavity to receive said ballast means therein.

17. A self-supporting lamp fixture as set forth in claim 16, wherein said ballast means comprises grains of sand which completely fill said cavity.

18. A self-supporting lamp fixture as set forth in claim 15, including a plurality of fastening screws extending through said upper wall of said segment of said sphere and said bottom wall of said lamp supporting structure at radially spaced apart locations around the periphery thereof to additionally secure said segment of said sphere comprising said self-positioning means to said lamp supporting structure.

19. A self-positioning lamp fixture as set forth in claim 1, wherein said lamp supporting structure includes socket means for a bulb, reflector supporting means to support a reflector in position to reflect light from a bulb in said socket means, and a flexible reflector supported in position by said reflector supporting means.

20. A self-positioning lamp fixture as set forth in claim 19, wherein said reflector supporting means comprises a cylindrical protective cage extending upwardly from said socket means to surround a said bulb in said socket means, said flexible reflector having releasable cage connecting means to releasably connect it to said cage in said position to reflect light from a said bulb in said socket means.

21. A self-positioning lamp fixture as set forth in claim 20, wherein said cylindrical protective cage includes a pair of diametrically opposed longitudinally extending protective bars, said releasable cage connecting means comprises a first tab movable between a fastening and an unfastening position for extending around a first one of said pair of longitudinally extending protective bars when in said fastening position, a second tab movable between a fastening and an unfastening position for extending around the second one of said pair of longitudinally extending protective bars when in said fastening position, first releasable tab connecting means to releasably hold said first tab around said first one of said longitudinally extending protective bars, and second releasable tab connecting means to releasably hold said second tab around said second one of said longitudinally extending protective bars.

22. A self-positioning lamp fixture as set forth in claim 21, wherein said first releasable connecting means includes a first strip of material having small hook end projections extending therefrom and a second strip of material having small hook receiving projections extending therefrom to releasably hold said hook end projections of said first strip when brought into contact therewith, one of said first and second strips being on said first tab of said releasable cage connecting means and the other of said first and second strips being on a facing portion of said flexible reflector which faces said strip on said first tab when said first tab is extended around said first one of said pair of longitudinally extending protective bars.

23. A self-positioning lamp fixture as set forth in claim 21, wherein said flexible reflector includes a body portion having an inwardly facing surface facing inwardly toward a said bulb in said socket means, said first and second tabs having inwardly facing surfaces facing inwardly toward a said bulb in said socket means when said tabs are in said fastening positioning, and reflective means on said inwardly facing surfaces of said body portion of said flexible reflector and of said tabs thereof.

24. A self-positioning lamp fixture as set forth in claim 19, wherein said flexible reflector comprises a semi-cylindrical flexible side wall, and an arcuately extending flexible top wall.

25. A self-positioning lamp fixture as set forth in claim 19, wherein said flexible reflector includes a sheet of flexible sheet material having an inwardly facing reflective surface facing inwardly of a said bulb in said socket means.

26. A self-positioning lamp fixture as set forth in claim 19, wherein said flexible reflector includes an inner layer of flexible sheet material facing inwardly of a said bulb in said socket means and an outer layer of flexible sheet material secured to said inner sheet.

27. A self-positioning lamp fixture as set forth in claim 26, wherein said inner layer of flexible sheet material includes a first sheet of flexible stainless steel foil facing inwardly of a said bulb in said socket means and a second sheet of flexible supporting material adhesively secured to said first sheet of flexible stainless steel foil.

28. A self-supporting lamp fixture as set forth in claim 26, wherein said inner layer of flexible sheet material comprises a flexible sheet product identified as Alpha Maritex Style 2025/9480 ST-HT available from Alpha Associates, Inc. of Woodbridge, N.J. comprising a sheet of stainless steel foil adhesively laminated to a sheet of heavy weight, plain weave, fiberglass cloth.

29. A self-positioning lamp fixture as set forth in claim 26, wherein said outer layer of flexible sheet material comprises a flexible sheet product identified as Alpha Maritex Style 3259-2-SS available from Alpha Associates, Inc. of Woodbridge, N.J. comprising a sheet of fiberglass fabric impregnated with silicone rubber which is water and oil resistant, flame retardant, can be easily sewn, is lightweight, has substantial tensile, tear and burst strength, and is useable throughout a temperature range from minus 67 degrees Fahrenheit up to plus 500 degrees Fahrenheit for 1000 hours on a continuous basis with no change in material characteristics.

30. A self-positioning lamp fixture as set forth in claim 29, wherein said reflective means includes stainless steel foil.

31. A self-positioning lamp fixture as set forth in claim 19, wherein said flexible reflector comprises foldable sheet material, said flexible reflector being foldable into a folded up position and unfoldable into an unfolded position, folded up releasable securing means on said flexible reflector to releasably hold it in its said folded up position, and fixture connecting means to releasably connect and hold said flexible reflector to said lamp supporting structure when it is in its said folded up position.

32. A self-positioning lamp fixture as set forth in claim 19, wherein said flexible protector comprises a first substantially rectangular piece of flexible sheet material having a substantially straight upper edge, a second substantially semi-circular piece of flexible sheet material having a substantially semi-circular edge, said substantially straight upper edge of said first piece being joined to said substantially semi-circular edge of said second piece.

* * * * *